US009653055B1

(12) United States Patent
Savage et al.

(10) Patent No.: US 9,653,055 B1
(45) Date of Patent: May 16, 2017

(54) VIBRATO TAILPIECE AND METHOD OF OUTPUT SIGNAL CONTROL FOR STRINGED INSTRUMENTS

(71) Applicants: Steven B. Savage, Portsmouth, NH (US); Harris Flaum, Brookline, NH (US)

(72) Inventors: Steven B. Savage, Portsmouth, NH (US); Harris Flaum, Brookline, NH (US)

( * ) Notice: Subject to any disclaimer, the term of this patent is extended or adjusted under 35 U.S.C. 154(b) by 0 days.

(21) Appl. No.: 15/130,466

(22) Filed: Apr. 15, 2016

(51) Int. Cl.

| | |
|---|---|
| ***G10H 1/46*** | (2006.01) |
| ***G10H 1/32*** | (2006.01) |
| ***G10H 1/02*** | (2006.01) |
| ***G10H 1/055*** | (2006.01) |
| ***G10H 3/18*** | (2006.01) |
| ***G10D 3/14*** | (2006.01) |

(52) U.S. Cl.
CPC ..... *G10H 1/0555* (2013.01); *G10D 3/146* (2013.01); *G10H 3/186* (2013.01); *G10H 2210/205* (2013.01); *G10H 2210/211* (2013.01)

(58) Field of Classification Search
USPC ..... 84/740
See application file for complete search history.

(56) References Cited

U.S. PATENT DOCUMENTS

| | | | | |
|---|---|---|---|---|
| 4,580,479 | A * | 4/1986 | Bonanno | G10H 1/46 84/626 |
| 4,658,690 | A * | 4/1987 | Aitken | G10H 1/342 84/267 |
| 7,049,504 | B1 * | 5/2006 | Galoyan | G10H 3/186 84/313 |
| 7,112,738 | B2 * | 9/2006 | Hyakutake | G10H 1/342 84/646 |
| 7,247,780 | B2 * | 7/2007 | Sanders | G10D 3/146 84/313 |
| 2008/0236374 | A1 * | 10/2008 | Kramer | G10H 1/0016 84/733 |

* cited by examiner

*Primary Examiner* — Christopher Uhlir
(74) *Attorney, Agent, or Firm* — Ross K. Krutsinger; Mesmer & Deleault PLLC

(57) ABSTRACT

A vibrato tailpiece system for a stringed instrument includes a tailpiece, a vibrato bar operable with the tailpiece and having an end portion rotatable about an axis of rotation, and a magnet attached to the end portion of the vibrato bar. A sensor chip is spaced from the magnet by a gap sufficiently small to enable the sensor chip to detect a change in the magnetic field due to a rotation of the vibrato bar. The sensor chip outputs a control signal based on the change in the magnetic field. A sensor circuit uses the control signal from the sensor chip to adjust or modify the pickup output signal based on the position of the vibrato bar and deliver an adjusted output signal to an output connector of the stringed instrument.

19 Claims, 8 Drawing Sheets

VIBRATO TAILPIECE AND METHOD OF OUTPUT SIGNAL CONTROL FOR STRINGED INSTRUMENTS

BACKGROUND OF THE INVENTION

1. Field of the Invention

The present invention relates generally to components and hardware for stringed musical instruments and more particularly to volume control for electric guitars and other stringed instruments.

2. Description of the Prior Art

Stringed instruments, particularly solid-body guitars, have been equipped with various types of bridges and tailpieces since the instrument was introduced. First developed by Bigsby and Fender, a tailpiece with a vibrato bar allows the player to effect vibrato and pitch changes by moving the vibrato bar up or down relative to the top of the guitar body to adjust the tension on the strings. As illustrated in FIG. 1, one type of prior-art vibrato tailpiece 8 has a vibrato block 11 connected to and extending transversely from the bottom side of a bridge plate 10. The vibrato block 11 extends through a vibrato cavity 19 in the body 4 of the guitar 5 with bottom portion 11*a* connecting to springs 28 that extend and connect to guitar body 4. Bridge plate 10 is able to pivot about pivot point 17 with springs 28 pulling against the the force of string tension. A vibrato bar 18, also known as a whammy bar or tremolo bar, engages vibrato block 11 with a first end 20 of vibrato arm 18 being inserted into vibrato block 11 through bridge plate 10. Vibrato bar 18 allows the player to pivot vibrato block 11 and bridge plate 10 against or with the force of spring(s) 28 to change tension on the strings 6 and alter the pitch for a vibrato or portamento effect. In addition to moving up and down in a rocking motion 22 relative to the top face 4*a* of the guitar body 4, vibrato bar 18 rotates in a 360 degree circular motion 24 about an axis extending through first end portion 20 of vibrato arm 18 as viewed looking at top face 4*a* of the guitar body 4. The circular, rotational motion allows the player to hold vibrato bar 18 as the player's hand moves across the strings as well as swing vibrato bar 18 away from strings 6 when vibrato arm 18 is not in use.

FIG. 2 shows another type of vibrato tailpiece 40 of the prior art that includes a frame 41 that can be screwed to the guitar body. Strings (not shown) attach to and wrap over a first rod 42 and then pass under a guide rode 44 before extending across a bridge (not shown) on their way to the headstock (not shown). Vibrato bar 46 attaches to a mounting bracket 48 connected to the end of first rod 42. A spring 50 biases vibrato bar 46 to a position over guitar body (not shown) and in balance with string tension. The player positions vibrato bar 46 by rotating it about a connector 52 that secures vibrato bar 46 to mounting bracket 48. The player changes the string tension, and therefore pitch, by pulling up or pushing down on vibrato bar 46 to rotate first rod 42 where the strings attach.

In addition to pitch changes using a vibrato tailpiece, guitarists also use the volume knob or a volume pedal to produce volume effects, such as swells and fade-ins. The guitarist typically plucks the strings while at the same time using the little finger to rotate the guitar's volume knob. Because the volume knob is often positioned to be out of the way of one's strumming hand, plucking the strings and adjusting the volume at the same time is difficult to do. Even more difficult is using the vibrato bar for a combination of pitch changes and volume changes performed all while picking or strumming. For the guitarist who uses a foot to control other effects pedals, such as a wah-wah pedal, using a foot-controlled volume pedal is poor option since the foot is already occupied with controlling another pedal.

Therefore, what is needed is a vibrato system for guitars and other stringed instruments that provides another option for plucking the strings while also adjusting pitch and/or the volume.

SUMMARY OF THE INVENTION

It is an object of the present invention to provide an improved vibrato system for stringed instruments, such as electric guitars.

It is an object of the present invention to provide a vibrato tailpiece capable of adjusting the instrument's volume as well as pitch.

It is an object of the present invention to provide and method of volume control based on movement of a vibrato bar.

The present invention achieves these and other objectives by providing a stringed instrument vibrato system having a vibrato tailpiece, and method of volume control, where rotating the vibrato bar about an axis of rotation can be used to change the output volume of the instrument. In one embodiment, the moving the vibrato bar causes a change in magnetic field that is used for volume control. For example, a sensor chip detects the magnetic field of a magnet located on the vibrato bar end portion or stem and sends a control signal to the instrument's electronics based on changes in the magnetic field. In another embodiment, and end portion of the vibrato bar operably engages a potentiometer electrically coupled to the instrument's output signal. In yet another embodiment, the instrument uses an optical sensor to detect movement of the vibrato bar, where the optical sensor may be positioned on the front face of the instrument.

One aspect of the present invention is directed to a vibrato tailpiece system for a stringed instrument. The vibrato tailpiece system includes a vibrato tailpiece with a vibrato bar operable with the vibrato tailpiece and having an end portion rotatable about an axis of rotation. A magnet is attached to the end portion of the vibrato bar and defines a magnetic field, where rotation of the vibrato bar about the axis of rotation moves the magnet. A sensor chip is spaced from the magnet by a gap sufficiently small to enable the sensor chip to detect a change in the magnetic field due to a rotation of the vibrato bar. The sensor chip outputs a control signal based on the magnetic field. A sensor circuit is coupled to the sensor chip and configured to receive a pickup output signal from a pickup of the stringed instrument, use the control signal from the sensor chip to adjust an amplitude of the pickup output signal, and deliver an adjusted output signal to an output connector of the stringed instrument.

In another embodiment, the system includes a bypass switch electrically coupled between the pickup(s) of the stringed instrument and the output connector. In a first position, the bypass switch delivers the pickup output signal to the output connector via the sensor circuit. In a second position, the bypass switch delivers the pickup output signal to the output connector without the sensor circuit.

In another embodiment, the magnet is a rare earth magnet. Examples of rare earth magnets include samarium-cobalt magnets and neodymium magnets.

In another embodiment, the control signal of the sensor chip is based at least in part on a change in strength of the magnetic field. In another embodiment, the control signal of the sensor chip is based at least in part on a change in direction of the magnetic field.

In another embodiment, the gap is sized to result in magnetic field saturation of the sensor chip. In one embodiment, the gap is less than 0.15 inch.

In some embodiments, the rotation of the vibrato bar is within a predefined sector of a circle. For example, the predefined sector is bounded by radii spaced by 45° or less.

In another embodiment, the sensor chip and the magnet are coaxially aligned along the axis of rotation.

In another embodiment, the sensor circuit uses the control signal from the sensor chip to attenuate the pickup output signal by an amount from 0 dB to 30 dB. In another embodiment, the sensor circuit uses the control signal to boost the pickup output signal by an amount from 0 dB to +10 dB.

In another embodiment of the present invention, the shape of the vibrato bar has a "U" shaped portion or loop, which allows the player to conveniently rotate it clockwise or counterclockwise, with the ring and/or little finger alone.

Another aspect of the present invention is directed to a method of volume control for a stringed instrument equipped with a vibrato tailpiece and one or more pickups. In one embodiment, the method includes the steps of providing a stringed instrument equipped with one or more pickups, a signal output connector, a vibrato tailpiece including a vibrato bar with an end portion rotatable about an axis of rotation, a magnet secured to the end portion of the vibrato bar, and a sensor circuit that includes a sensor chip capable of detecting a change in a magnetic field of the magnet, where the sensor chip is disposed sufficiently close to the magnet to detect the change in the magnetic field; the sensor circuit receiving a pickup output signal from one or more pickups of the stringed instrument; rotating the vibrato bar about the axis of rotation within a predefined sector of a circle, thereby causing the magnet to move relative to the sensor chip; the sensor chip detecting a property of the magnetic field based on the position of the magnet; the sensor chip outputting a control signal to the sensor circuit based on the position of the vibrato bar; the sensor circuit modifying the pickup output signal based on the control signal of the sensor chip, thereby providing an modified output signal corresponding to a position of the vibrato bar within the predefined sector; and delivering the modified output signal to a signal output connector of the stringed instrument. In one embodiment, the property of the magnetic field is a field direction and/or a field strength. In another embodiment, the predefined sector of a circle of 45° or less.

In one embodiment, modifying the pickup output signal is adjusting an amplitude of the pickup output signal. In one embodiment, for example, the sensor circuit adjusts the pickup output signal by an amount from −30 dB to +10 dB.

In another embodiment, the step of providing a stringed instrument includes selecting the stringed instrument equipped with a bypass switch electrically coupled between the signal output connector and the one or more pickups, where the bypass switch is configured to selectively bypass the sensor circuit. For example, the bypass switch and the master volume potentiometer comprise a combination push-pull volume potentiometer/switch. In another embodiment, the bypass switch is a toggle switch. As such, using the vibrato bar to control volume is a mode that is selectively engaged or bypassed with a toggle switch or a push/pull type volume knob/switch attached to the instrument.

In another embodiment, the step of providing a stringed instrument includes selecting the stringed instrument with the sensor chip configured for anisotropic magnetoresistance, where the gain control signal is based on a direction of the magnetic field.

In another embodiment, the step of installing the vibrato bar on the vibrato tailpiece positions the magnet sufficiently close to the sensor chip throughout a predefined range of motion of the vibrato bar to result in field saturation of the sensor chip.

An advantage of the vibrato system and method of the present invention is that it not only allows the player to adjust the pitch of the strings, but also uses all or part of the 360 degree rotational movement of the vibrato bar to change the instrument's volume, tone, or other effect.

DETAILED DESCRIPTION OF THE PREFERRED EMBODIMENT

Figure 3:
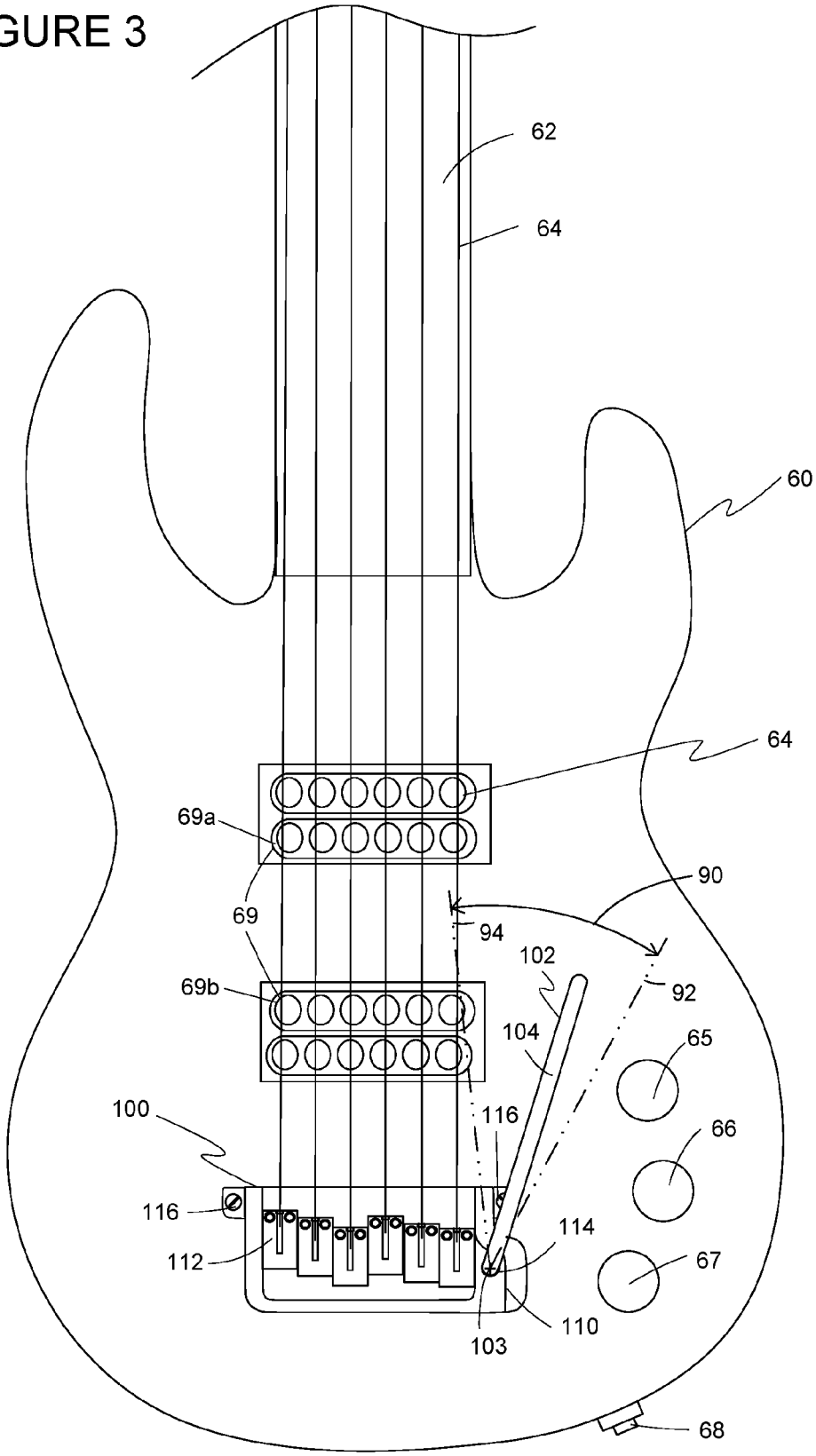
FIG. 3 is a front view of a guitar body showing one embodiment of a vibrato tailpiece system of the present invention installed in the guitar body.

The preferred embodiments of the present invention are illustrated in FIGS. 3-11. FIG. 3 illustrates a plan view of a guitar body 60 equipped with one embodiment of a vibrato tailpiece system 100. A portion of a guitar neck 62 and strings 64 are also shown. Vibrato tailpiece system 100 includes a vibrato tailpiece 110, a vibrato bar 102 operable with vibrato tailpiece, a sensor chip 142 (shown in FIGS. 4-9), and a sensor circuit 200 (shown in FIGS. 8-9) coupled to sensor chip 142 and the instrument's electronics group 64. Sensor chip 142 and sensor circuit 200 are discussed in more detail below. In some embodiments, vibrato tailpiece 110 also includes a bridge 112.

Guitar body 60 has guitar electronics group 64 that includes one or more pickups 69 and an output connector 68.

Guitar electronics group 64 may be as simple or as complex as desired. For example, a simple embodiment of guitar electronics group 64 includes a single pickup 69 wired to output connector 68, which is typically a ¼" audio jack. Additional controls for volume 65, tone 66, pickup selection/blend 67, and the like are optional and are included in guitar electronics group 64 as desired. Guitar electronics group 64 of FIG. 3 includes pickups 69*a*, 69*b* wired to a master volume potentiometer 65, a tone potentiometer 66, a pickup blend potentiometer 67, and output connector 68. Guitar electronics group 64 is electrically coupled to sensor circuit 200 of vibrato tailpiece system 100 as discussed in more detail below. Volume potentiometer 65 optionally includes a push/pull switch to bypass use of sensor circuit 200. Other bypass switches are also acceptable.

Figure 4:
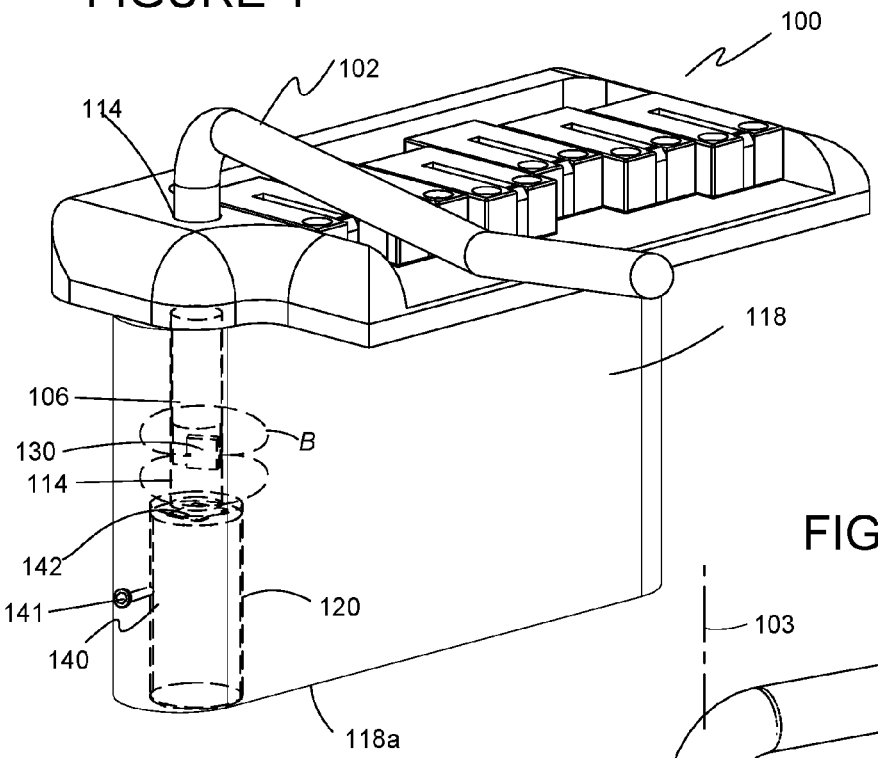
FIG. 4 is a perspective view the vibrato tailpiece of FIG. 3 showing a magnet and sensor chip disposed in the vibrato block.

Vibrato bar 102 has an arm portion 104 and a stem or end portion 106 (shown in FIG. 4.) End portion 106 is installed in or attached to vibrato tailpiece 110 and rotates about an axis of rotation 103. In one embodiment, end portion 106 extends transversely from arm portion 104 and is constructed for insertion into a vibrato bar socket 114 in vibrato tailpiece 110, where end portion 106 extends along axis of rotation 103. In some embodiments, vibrato bar socket 114 is threaded to receive a threaded end portion 106 of vibrato bar 102. In other embodiments, vibrato bar socket 114 is configured for a snap-fit with end portion 106. When inserted into vibrato bar socket 114, for example, the player grips arm portion 104 to either rotate vibrato bar 102 about end portion 106 and/or to pivot tailpiece 110 about pivot points 116 to change the tension on strings 64. In some embodiments, pivot points 116 are screws or posts that extend from guitar body 60 to engage vibrato tailpiece 110 to maintain its position relative to the instrument's headstock (not shown).

In some embodiments of vibrato tailpiece system 100, sensor circuit 200 (discussed below) is configured to provide gain or attenuation when vibrato bar 102 is within a predefined sector 90 between a first radius 92 and a second radius 94. In one embodiment, sector 90 is 90° or less, such as 45°, 30°, or other angle. For example, first radius 92 defines a first gain (e.g., −20 dB or −30 dB) of control circuit 200 and second radius defines a second gain (e.g., 0 dB). Sector 90 may include regions of gain and/or attenuation as desired by adjusting gain settings of sensor circuit 200 and the position of sensor chip 142. In one embodiment, first radius 92 extends from axis of rotation to a point in the general direction of volume potentiometer 65 and second radius 94 extends generally along strings 64 or across strings 64. Sector 90 may be adjusted in size and position as desired. In some embodiments, sector 90 includes the full 360° rotation about axis of rotation 130.

Referring now to FIG. 4, a perspective illustration shows vibrato tailpiece 110 of FIG. 3 with end portion 106 of vibrato bar 102 inserted into vibrato bar socket 114 defined in a vibrato block 118. As such, vibrato bar 102 is used to adjust the tension on strings 64 (shown in FIG. 2) as discussed above. A permanent magnet 130 is mounted to end portion 106 of vibrato bar 102. When inserted into vibrato bar socket 114, magnet 130 is positioned sufficiently close to a sensor chip 142 that is responsive to changes in a magnetic field B as magnet 130 moves with vibrato bar 102. Sensor chip 142 may be disposed in vibrato bar socket 114, mounted to vibrato block 118, or attached at another location on vibrato tailpiece 110. In one embodiment, vibrato block 118 defines a sensor recess or opening 120 to receive and retain a sensor chip assembly 130 that includes sensor chip 142. In one embodiment, sensor opening 120 is coaxially aligned with socket 114 and extends through bottom surface 118*a* of vibrato block 118 towards vibrato bar socket 114.

Sensor chip assembly 140 is retained in sensor opening 120 of vibrato block 118 by any one of a variety of methods. For example, sensor chip assembly 140 is adhered within opening 120, held by an interference or pressure fit in sensor opening 120, retained by threaded engagement, or retained by a snap fit in sensor opening 120, retained using a set screw 141, or other means. A set screw 141 is useful to retain sensor chip assembly 140 in sensor opening 120 and also to allow removal and adjustment of sensor chip assembly 140.

Figure 5:
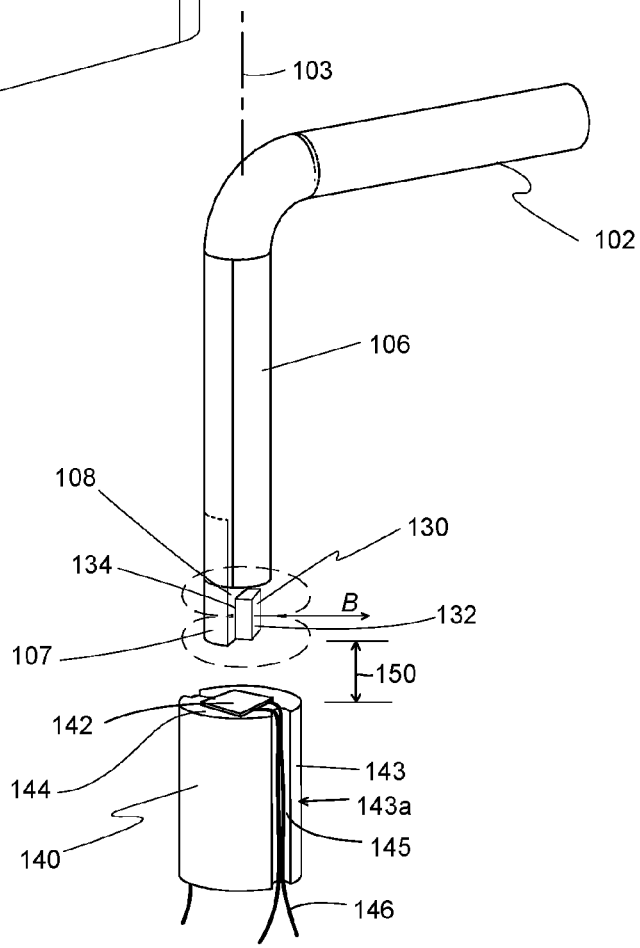
FIG. 5 is a perspective view of part of the vibrato bar and sensor chip assembly of FIG. 4.

Referring now to FIG. 5, a perspective illustration shows a portion of vibrato bar 102 and sensor chip assembly 140 of FIG. 4 separated from vibrato tailpiece 110. Magnet is fixedly attached to end portion 106 at or near distal end 107 of vibrato bar 102 and spaced from sensor chip 142 by a gap 150. In one embodiment, magnet 130 is a rare-earth magnet (e.g., a neodymium or samarium-cobalt magnet) with a North pole 132 and a South pole 134 defining a magnetic field B oriented transversely (e.g., perpendicularly) to an axis of rotation 103 of vibrato bar 102. In some embodiments, end portion 106 has a recess 108 to receive magnet 130. For example, recess 108 extends axially into distal end 107 of end portion 106 and has a square shape to receive a magnet 130 with a block shape. As illustrated in FIG. 5, for example, South pole 134 abuts recess 108 and North pole 132 faces away from recess 108. In other embodiments, recess 108 is a flat or slot machined into distal end 107 of end portion 106. In some embodiments, magnet 130 is fixed to distal end 107 of end portion 106 using adhesive or the like.

Sensor chip assembly 140 includes a support member 143 made of a non-conductive material and sensor chip 142 attached to or supported by support member 143. In one embodiment, support member 143 has a support member end 144, where support member 143 is received in sensor opening 120 in vibrato block 118 (shown in FIG. 4) with support member end 144 facing towards end portion 106 of vibrato bar 102. For ease of manufacturing, sensor opening 120 is a cylindrical bore and support member 143 is a cylinder or other shape sized to be retained in sensor opening 120. In one embodiment, support member 143 is a plastic cylinder with one or more channels 145 extending axially along an outside surface 143*a* and sized to receive a wire or wires 146 connected to sensor chip 142. For ease of mounting sensor chip 142, support member end 144 preferably is flat and square to outside surface 143*a* (e.g., the flat end of a cylinder.) In other embodiments, electrical contacts of sensor or wires 146 connected thereto extend through hollow support member 143. In yet other embodiments, support member 143 is a wad of adhesive, tape, foam, or other material that holds together wires 146 connected to sensor chip 142 and retains the position of sensor chip 142 relative to magnet 130.

Sensor chip 142 is spaced from magnet 130 by gap 150, which may be constant or variable. Optionally, gap 150 is adjustable, such as when sensor chip assembly 140 is retained in sensor opening 120 by set screw 141 or by threaded engagement. In some embodiments, gap 150 is fixed and constant, where sensor chip 142 detects only a change in direction of magnetic field B. The distance of gap 150 is determined by the size magnet 130 and its magnetic field B, the type and sensitivity of sensor chip 142, and other factors. Optionally, the user may change gap 150 as needed to adjust the performance of sensor circuit 200.

In some embodiments, it is desirable for sensor chip 142 to operate in field saturation so that minor changes in gap 150 have no effect on the control signal used to control the instrument's volume. For example, sensor chip 142 is insensitive to changes in gap 150 due to vibration or changes in gap 150 due to movement of magnet 130 relative to sensor chip 142.

In one embodiment, sensor chip 142 employs one or both of two methods of magnetic detection. A change in a gap 150 between magnet 130 and sensor chip 142 affects the strength of the magnetic field B; rotation of magnet 130 results in a change in the direction of the magnetic field B. Field strength and/or field direction affect the control signal from sensor chip 142 and can be used to control volume.

Figure 1:
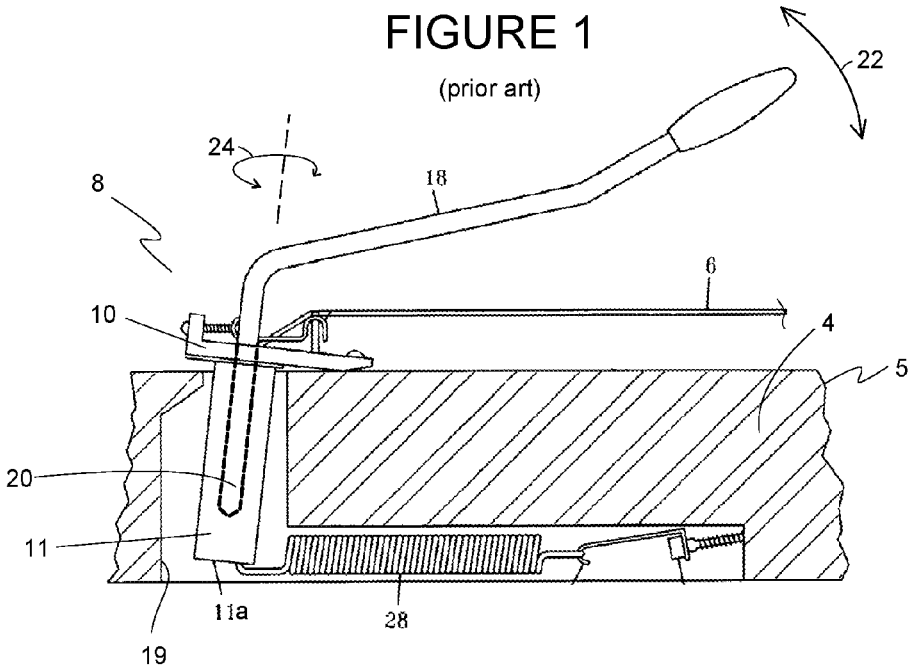
FIGURE 1 (prior art)
FIG. 1 is a side sectional view of part of a guitar body showing one embodiment of a prior-art vibrato tailpiece installed in a guitar body.

In one embodiment, sensor chip 142 is sensitive to changes in field direction and utilizes a magneto-resistive bridge circuit such as the Honeywell HMC1501 chip. Based on the magnetic field B applied to sensor chip 142, the rotation or angular position of vibrato bar 102 is converted into a voltage which is then used to control the guitar signal amplitude through a voltage controlled amplifier set to have a maximum gain value. In one embodiment, the maximum gain value is one; other maximum gain values greater than one or less than one are acceptable. The control signal amplifier 250 and voltage-controlled amplifier 260 are connected in series with the instrument's volume potentiometer 31 (shown in FIG. 1) and use the output or control voltage of sensor chip 142 to control the instrument's output signal.

In another embodiment, sensor chip 142 is sensitive to changes in magnetic field strength and uses a Hall Effect sensor, such as the Infineon 4997 chip. As gap 150 changes, the strength of magnetic field B changes. Sensor chip 142 outputs a control signal based on the strength of magnetic field B applied to sensor chip 142. For example, sensor chip 142 is a Hall Effect chip such as the Infineon 4997 chip that detects changes in magnetic field strength as magnet 130 moves relative to sensor chip 142. Thus, sensor chip 142 is sensitive to changes in the magnetic field B and outputs a control signal used to attenuate (or boost) the output signal from the guitar's pickup(s) 35.

For example, sensor chip 142 is a Hall Effect chip that is mounted on a sidewall 119 of vibrato block 118, to a wall of the guitar's vibrato cavity 19 (shown in FIG. 1), or a location on vibrato tailpiece 110 where rotation of vibrato bar 102 about axis of rotation 103 (and therefore rotation of magnet 130) changes the size of gap 150 between magnet 130 and sensor chip 142. As gap 150 increases, the strength of magnetic field B decreases. Sensor chip 142 detects this change in field strength and accordingly provides a control output signal that is used to affect the instrument's output signal volume.

Figure 2:
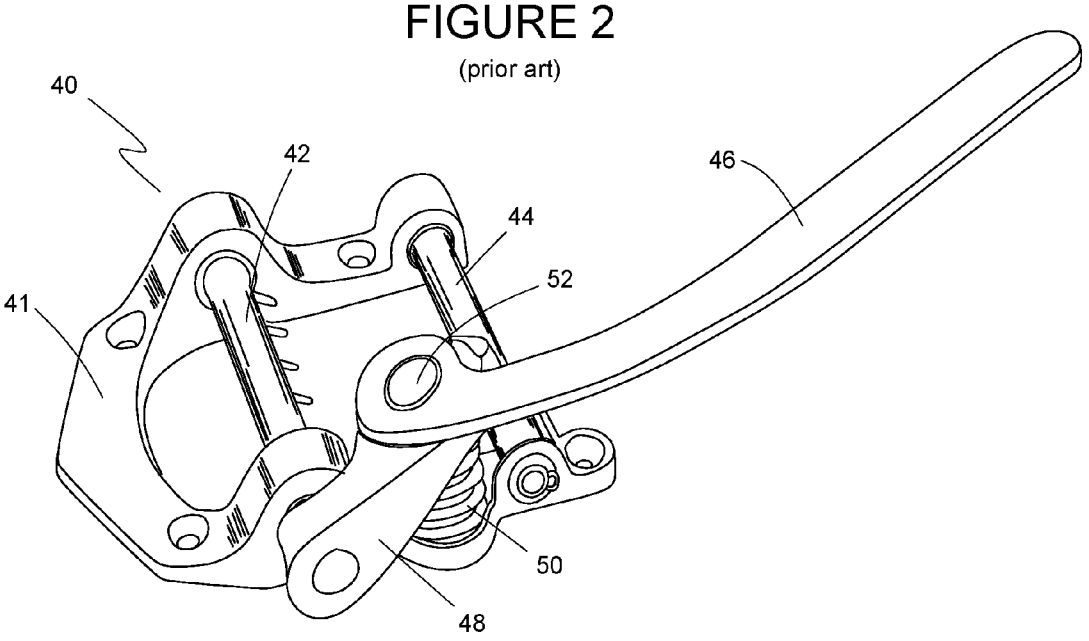
FIGURE 2 (prior art)
FIG. 2 is a perspective view of another embodiment of a vibrato tailpiece of the prior art.
Figure 6:
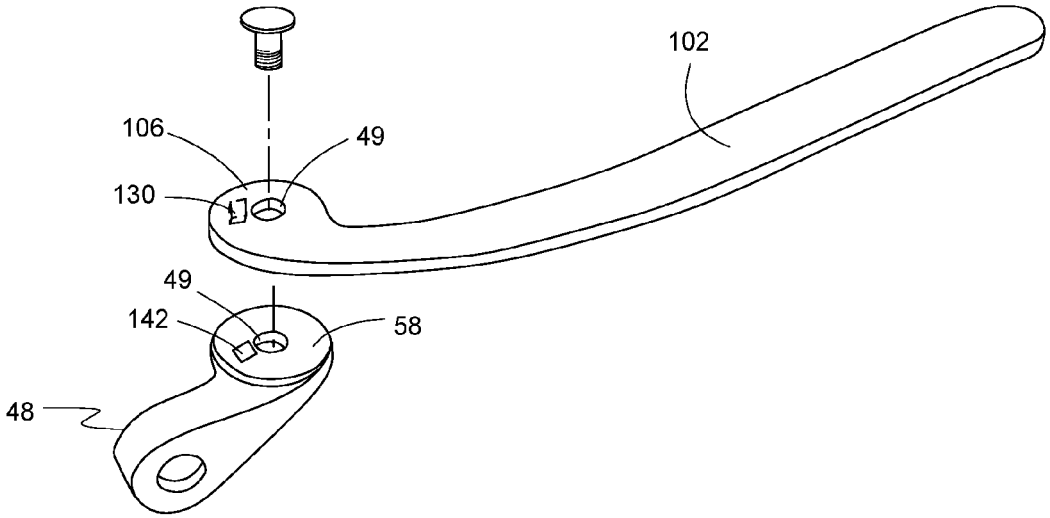
FIG. 6 is a perspective view of an embodiment of a vibrato bar and mounting bracket of the present invention configured for use with the vibrato tailpiece of FIG. 2.

Referring now to FIG. 6, one configuration is shown of vibrato bar 102 and mounting bracket 48' useful as replacements for vibrato bar 46 and mounting bracket 48 of FIG. 2. End portion 106 of vibrato bar 102 attaches to mounting bracket 48' using fastener 52 that allows rotation of vibrato bar 102 about fastener hole 49 through bar-attachment face 58. In one embodiment, sensor chip 142 is embedded in or otherwise attached to bar-attachment face 58 of mounting bracket 48' and does not interfere with rotation of vibrato bar 102. Magnet 130 is embedded in or attached to a bottom face 106*a* of end portion 106 and positioned to align with sensor chip 142 when vibrato bar 102 is in use. In one embodiment, sensor chip 142 is immediately adjacent fastener opening 49 to minimize the change in field strength as vibrato bar 102 rotates.

Figure 7:
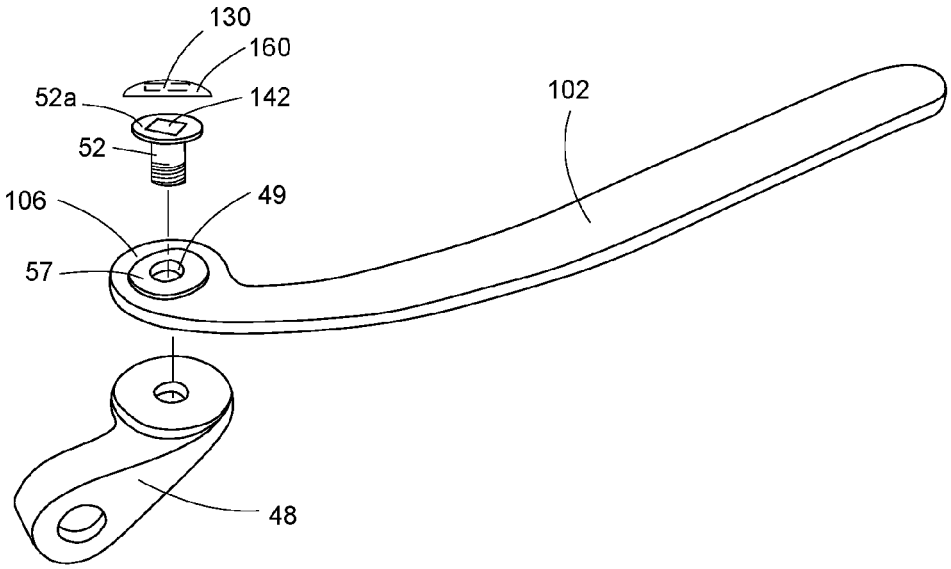
FIG. 7 is a perspective view of another embodiment of a vibrato bar configured for use with the mounting bracket and vibrato tailpiece of FIG. 2.

FIG. 7 illustrates another embodiment of vibrato bar 102 that replaces vibrato bar 46 and is usable with mounting bracket 48 and vibrato tailpiece of FIG. 2. Sensor chip 142 is attached to an end 52*a* of fastener 52. Magnet 130 is retained in a fastener cap or cover 160, where cover 160 is installed onto end portion 106 with magnet 130 axially aligned with sensor chip 142. For example, cover 160 secures to end portion 106 by engaging lip 57 around fastener opening 49 or other feature on end portion 106. Cover 160 could be made removable (e.g., snap fit, threaded attachment, or secured with fasteners), openable (e.g., hinged), or permanently attached over end portion 106. As vibrato bar 102 rotates, spacers and washers (not shown) typical of vibrato tailpiece 40 of FIG. 2 maintain fastener 52 in a fixed position without rotating. Therefore, relative movement between magnet 130 and sensor chip 142 results in a change in magnetic field B.

One embodiment of magnet 130, for example, is a pressed samarium/cobalt magnet such as the Honeywell 103MG5 sensor magnet, which has dimensions of 2 mm×2 mm×1 mm thick and a room-temperature magnetic field B of about 1110 Gauss at 0.25 mm and 120 Gauss at 2.54 mm. Other magnets 130 may be used as appropriate for the space available, the particular sensor chip 142, size of gap 150, and other considerations.

Using the Honeywell 103MG5 magnet 130 with a magnetic displacement sensor such as the Honeywell 1501/1512 sensor chip 142, gap 150 of about 0.25 inch results in 50% field saturation and gap 150 of about 0.15 inch results in full saturation. Accordingly, to ensure operation of sensor chip 142 in full saturation, gap 150 is preferably less than 0.15 inch, such as 0.10 inch. When gap 150 is sized to result in less than full magnetic field saturation, changes in gap 150 may affect the output voltage of sensor chip 142. In one embodiment where gap 150 is sized to result in full saturation, sensor chip 142 is configured to detect the direction of the magnetic field B resulting from the angular position or rotation of magnet 130 about axis of rotation 103. As magnet 130 rotates about the axis of rotation 103, the direction of the magnetic field B changes and is detected by sensor chip 142. Due to field saturation, sensor chip 142 is insensitive to changes in gap 150 that may result from misalignment of magnet 130 and sensor chip 142.

In yet another embodiment of vibrato tailpiece system 100, sensor chip 50 detects the linear translation of magnet 130. For example, magnet 130 is attached to or retained by arm portion 104 of vibrato bar 102 and sensor chip 142 is retained in guitar body 20. As arm portion 104 is moved across guitar body 20, magnet 130 sweeps over sensor chip 142, which detects the change in the strength of magnetic field B and/or change in direction of magnetic field B. An arc of about 30° corresponds to the typical range of rotational motion of vibrato bar 102. Although the movement of magnet 130 follows an arc in this example, sensor chip 142 is capable of detecting both linear and rotational translations of magnet 130.

Figure 8:
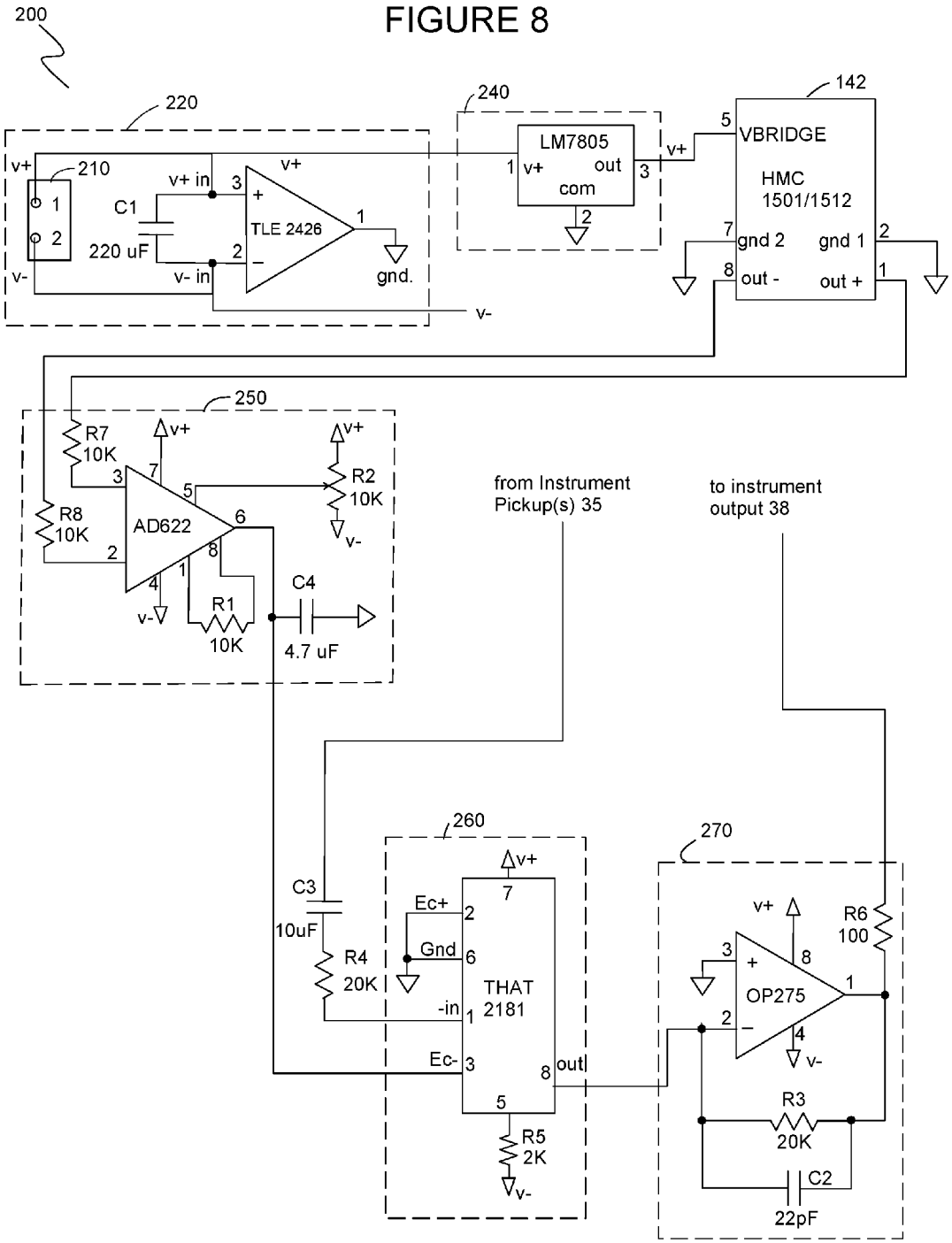
FIG. 8 is a circuit diagram of one exemplary embodiment of a sensor circuit coupled to a sensor chip where the outputted control signal is based on the direction of the applied magnetic field.
Figure 9:
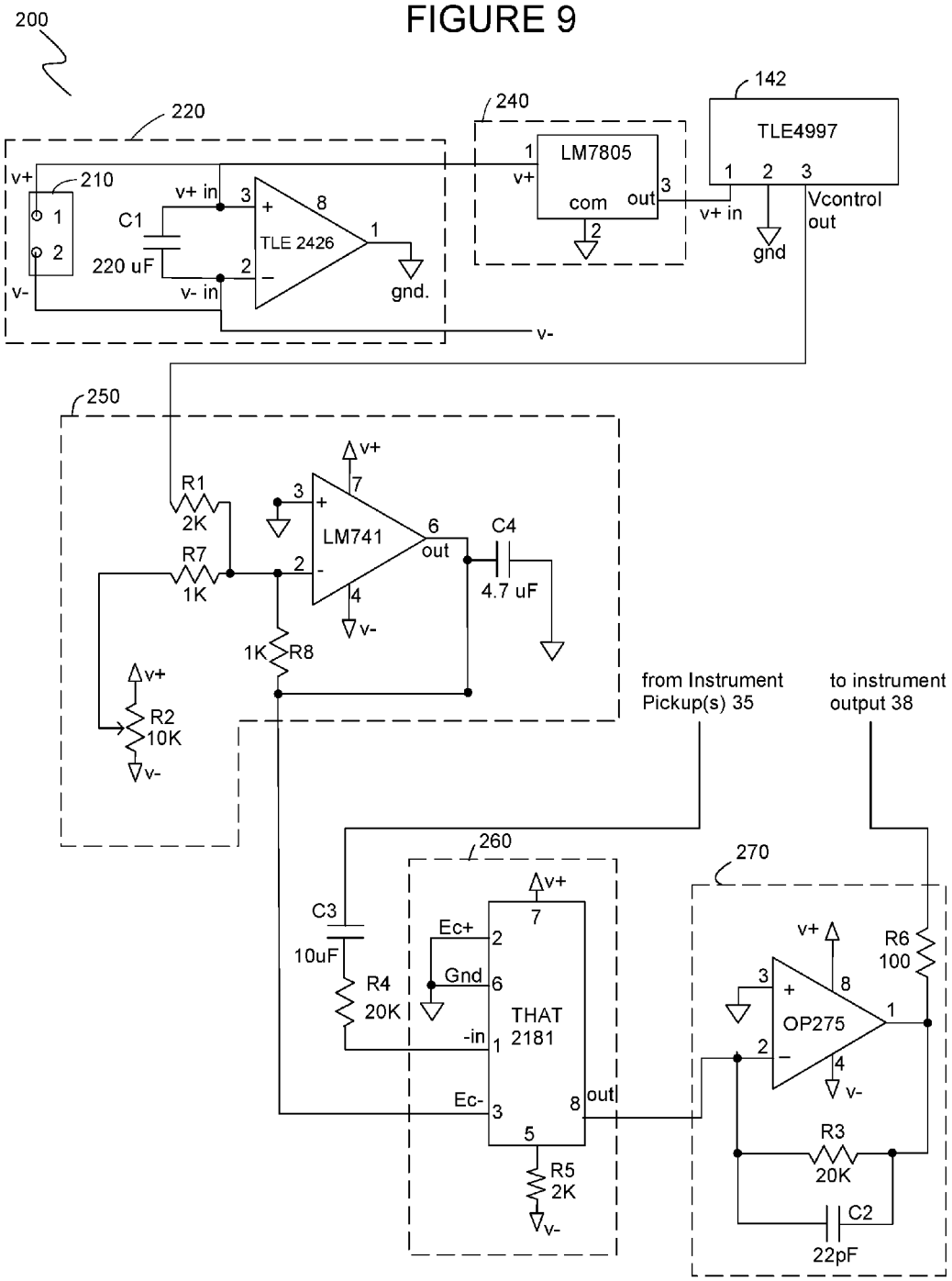
FIG. 9 is a circuit diagram of another exemplary embodiment of a sensor circuit coupled to a sensor chip is a Hall Effect sensor, where the outputted control signal is based on the strength of the applied magnetic field.

Referring now to FIGS. 8 and 9, circuit diagrams illustrate exemplary embodiments of a sensor circuit 200 coupled to sensor chip 142. Sensor circuit 200 includes a voltage source or battery 210, a virtual ground 220, a voltage regulator 240, a control signal amplifier 250, voltage-controlled amplifier 260, and current-voltage converter 270. Sensor chip 142 outputs a control signal with a voltage based on the strength and/or direction of magnetic field B. The output signal is used by voltage-controlled amplifier 260 to control the amplitude of the pickup output signal.

Sensor circuit 200 illustrated in FIG. 8 is configured for use with a magneto-resistive sensor chip 142, such as the Honeywell HMC1501 or HMC1512 that detects the direction of magnetic field B. In contrast, sensor circuit 200 in FIG. 9 is configured for use with a Hall Effect sensor chip 142, such as the Infineon 4997. Sensor circuits 200 in both FIGS. 8-9 are configured for use with a 9*v* battery 210 and are designed to have a maximum gain of 1.0. Other power sources or batteries 210 may be used as desired. Sensor circuit 200 may be configured for other gains greater than or less than 1.0.

In both FIGS. 8-9, battery 210 is connected to pins 2 and 3 of the virtual ground circuit 220 (a.k.a. "rail splitter") where 9 v from the battery 210 becomes voltage outputs of about +4.5 v, −4.5 v, and a virtual ground at 0 v. The output voltage is used to power other devices at the v+ and v− connections, where v+ is about 4.5 volts and v− is about −4.5 volts. The virtual ground signal of pin 1 connects to earth and to the ground on each block of sensor circuit 200. The positive voltage (e.g., +4.5 v) at pin 3 and virtual ground at pin 1 is the voltage used to power sensor chip 142; the positive voltage at pin 3, virtual ground at pin 1, and negative voltage at pin 2 are used to power control signal amplifier 250, voltage-controlled amplifier 260, and current-voltage converter 270. Other batteries 210 or voltage sources are acceptable provided that the voltage difference between voltage outputs is sufficient to operate the circuit (typically ±2.5 volts or greater). A larger supply voltage from battery 210 provides a larger control signal generated by sensor chip 142. Voltage regulator 240 is an optional block in circuit 200 and is used to provide a steady voltage to sensor chip 142 and other components so as to minimize unwanted changes in gain. Voltage regulator 240 is more desirable when sensor chip 142 is a Hall Effect sensor as in FIG. 9 to address decreasing voltage of battery 210 over time; this change in voltage from battery 210 can affect the operation of circuit 200.

In one embodiment, voltage regulator 240 is a Fairchild LM7805 chip. For various orientations of magnet 130, one can control the sensitivity of the gain of control signal amplifier 250 for a given angle of vibrato bar 102 by changing the gain resistor R1 across the AD622 chip and also adjusting the trim pot R2, which sets the offset or reference voltage delivered to VCA 260.

As discussed above, sensor chip 142 uses magnetoresistance and an applied magnetic field B to deliver a sensor output signal to control signal amplifier 250 where the voltage is amplified before being sent to pin 3 of the voltage-controlled amplifier (VCA) 260 as the control current Ec−. In some embodiments, a resistance of sensor chip 142 changes due to the strength of magnetic field B, resulting in different values of the control signal. In other embodiments, sensor chip 142 uses anisotropic magnetoresistance, where the resulting output signal is based on the direction of magnetic field B.

In embodiments using the Honeywell HMC 1501/1512, such as shown in FIG. 8, magneto-resistive sensor chip 142, control signal amplifier 250 preferably includes an Analog Devices 622 chip. Control signal amplifier 250 amplifies the voltage of the control signal received from sensor chip 142 so it can be used by VCA 260 to adjust the amplitude of the pickup output signal received from the instrument pickup(s) 35. Gain of control signal amplifier 250 is set by resistor R1, which at 20KΩ is about 3.5 and at 10 KΩ is about 6. A gain of 6 results in predefined sector 90 (shown in FIG. 3) with an angular range of about 30°. The trim pot resistor R2 provides an offset voltage that controls the maximum gain of circuit 200 throughout the entire 360° of vibrato bar 102.

Output from pin 6 of AD622 chip in control signal amplifier 250 is typically between 0 v and 0.7 v. The amplified control signal is delivered to pin 3 of the THAT 2181 chip in VCA 260. Gain of VCA 260 is set based on the voltage received from control signal amplifier 250 and is used to adjust instrument's pickup output signal from pickup(s) 35 delivered to pin 1 of THAT 2181 in VCA 260. For example, an output control voltage of 0 v from control signal amplifier 250 results in a gain of 1 for VCA 260; an output control voltage of 0.7 v from control signal amplifier 250 results in attenuation of 20 dB to 30 dB by VCA 260. The output signal of VCA 260 is converted from current to voltage by current-voltage converter 270 and then delivered to the instrument's output connector 38 (shown in FIG. 3.)

In one embodiment, VCA 260 is a THAT 2181 chip designed for high-performance audio applications with wide dynamic range, low distortion, and low noise. The THAT 2181 requires a supply voltage of about ±4 v or greater. VCA 260 converts the pickup output signal from pickup(s) 35 to current, then amplify and modulate the current signal. Other models of VCA 260 are acceptable to provide an output voltage to output connector 38 that is between about 100 mv and 1 v RMS typical of instrument-level output signals. As is typically used for audio applications, an output signal of up to about 300 mv is considered "instrument level" for −10 dB inputs and about 1.2 v is considered "line level" for +4 dB inputs. Thus, the gain of VCA 260 may be chosen to deliver the desired output signal level from the instrument.

Current-voltage converter 270 then converts the current signal output from VCA 260 back to voltage for delivery to the instrument's output connector 38. Resistors R3 (20 KΩ) in current-voltage converter 270 and R4 (20 KΩ) at the input to VCA 260 are recommended to optimize competing values of bandwidth and noise; other resistor values may be used as desired for a desired bandwidth or noise level. In one embodiment, current-voltage converter 270 is an OP275 chip made by Analog Devices. The OP275 chip requires a minimum supply voltage of ±4.5 volts. Other op amps are acceptable, including the Analog Devices OP90, which has a minimum supply voltage of ±2.6 volts. Another acceptable op amp is the NJM4580D made by National Japan Radio Company, which is especially suited to audio applications and also operates with a lower minimum supply voltage compared to the OP275.

Optionally, an input capacitor C3 of 10 μF isolates circuit 200 from external DC sources and input resistor R4 of 20 KΩ provides the desired input resistance. Resistors R7 and R8 in control signal amplifier 250 of FIG. 9 are also optional, but are useful to protect the AD622 chip from over current. Capacitor C4 in control signal amplifier 250 shunts AC feedback voltage from the audio signal and prevents any AC voltage from modulating VCA 260, which should receive only DC control voltage as a result of moving vibrato bar 102. Capacitor C1 in rail splitter 220 is optional and is useful to remove ripples in the supply voltage coming from an AC-powered voltage supply.

Referring to FIG. 9, an example of sensor circuit 200 is shown for sensor chip 142 being a Hall Effect sensor. For example, sensor chip 142 is the TLE 4997 linear Hall Effect sensor by Infineon. Battery 210, virtual ground 220, voltage regulator 240, VCA 260, and current-voltage converter 270 are configured and function as described above with reference to FIG. 8. Since the connections and output (about 1 mA) are different for the Infineon TLE 4997 sensor chip 142, control signal amplifier 250 utilizes the LM 741 amplifier by Texas Instruments or other suitable general purpose operational amplifier. Output voltage of the TLE 4997 varies linearly with supply voltage and with the applied magnetic field B. Using an input voltage of +4.5 v, for example, the control signal output from TLE 4997 sensor chip 142 varies from 0 v to +4.5 v depending on orientation and strength of magnetic field B. As with sensor circuit 200 discussed above with reference to FIG. 8, the output signal from pin 6 of control signal amplifier 250 is current Ec− delivered to pin 3 of VCA 260 and determines the gain of VCA 260.

In another embodiment of the invention, vibrato bar 102 provides volume control where sensor chip 142 is an optical sensor fixed to the guitar body 20, a pickguard (not shown) attached to the guitar body 20, the vibrato bar 102, the tailpiece 110, or another location on the instrument. Sensor chip 142 is an optical sensor that detects or tracks movement of the vibrato bar 102 and adjusts the instrument's output volume based on the position of vibrato bar 102. For example, sensor chip 142 is an optical sensor positioned on the guitar between bridge pickup 35*a* and master volume potentiometer 31 and uses a change in light intensity to detect the position of arm portion 104 of vibrato bar 102. When arm portion 104 is positioned proximate the lower edge of bridge pickup 35*a*, for example, volume is not attenuated; when arm portion 104 is positioned over master volume potentiometer 31 or is further rotated towards the lower edge of guitar body 20, the volume is attenuated by an amount from 0 dB and 30 dB.

Figure 10:
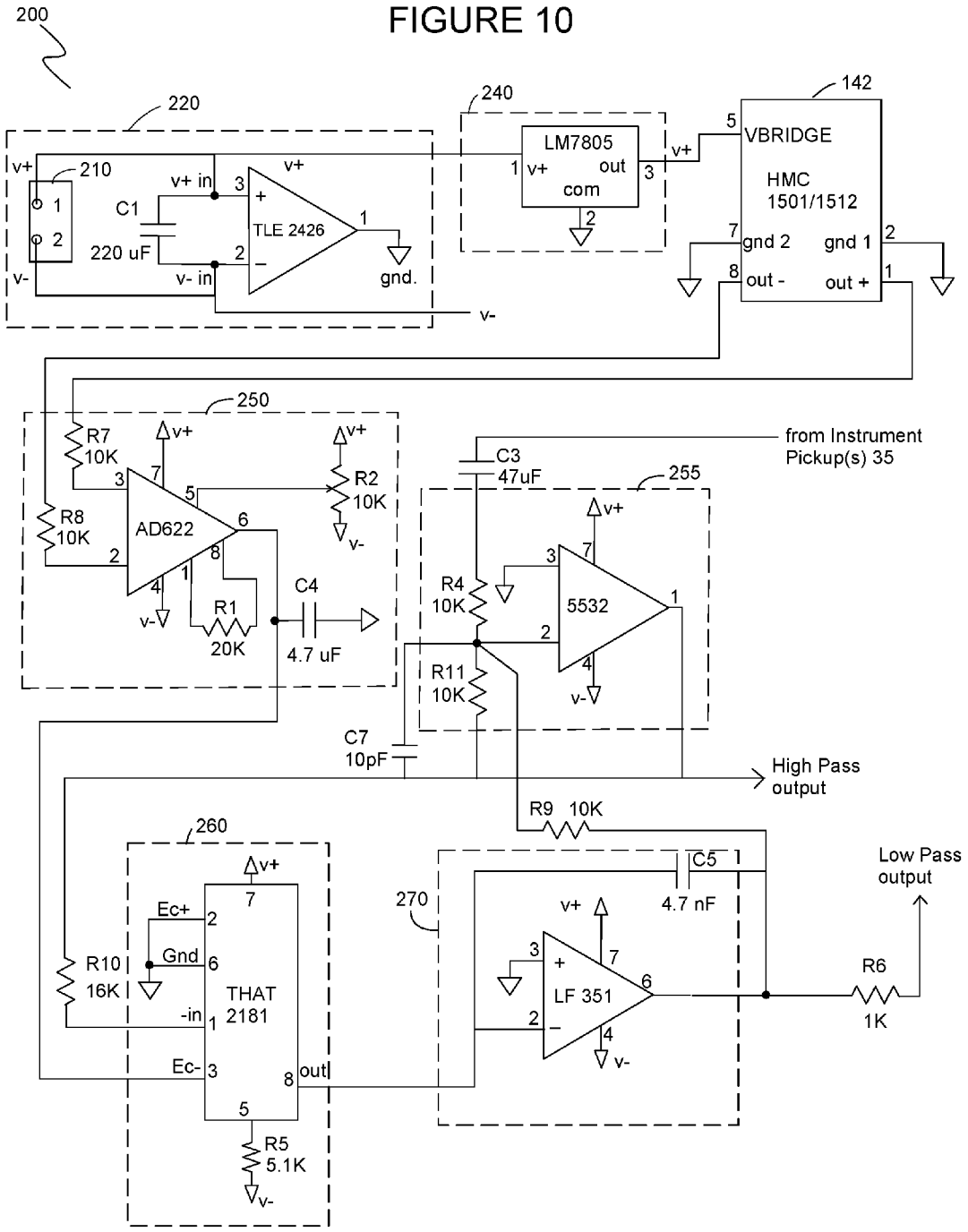
FIG. 10 is a circuit diagram of another exemplary embodiment of a sensor circuit used to adjust tone based on voltage of a magnetic sensor chip.

Referring now to FIG. 10, an exemplary circuit diagram is illustrated for adjusting the tone. Circuit 200 of FIG. 10 includes sensor chip 142, battery 210, voltage regulator 240, and virtual ground 220 as discussed above with reference to FIG. 8, where the control voltage from sensor chip 142 is measured between output pin 1 and output pin 8 of sensor chip 142 (e.g., Honeywell 1501.) Circuit 200 has two outputs, namely, a low pass output and a high pass output. Circuit 200 adds op amp 255 (e.g., Texas Instruments NE5532), which in combination with THAT 2181 of voltage-controlled amplifier 260 and op amp 280 (e.g., Texas Instruments LF 351) comprise a filtering/feedback circuit 290. A high pass/low pass filtering effect is obtained by the op amp feedback together with the selection of R10 (16 KΩ) and capacitor C5 (4.7 nF). The frequency range over which filtering occurs is determined by filtering in the audio range. The gain of the voltage-controlled amplifier 260 (THAT 2181 chip) is controlled by movement of vibrato bar 102 and the resulting output of sensor chip 142. The variable gain provides a variable filter cutoff range or a variable tone control circuit. Op amps LF351 and NE5532 are selected for having low noise, low distortion, and desirable bandwidth characteristics. Using circuit 200 of FIG. 10 could allow one to generate a "wah" effect controlled by vibrato bar 102.

Figure 11:
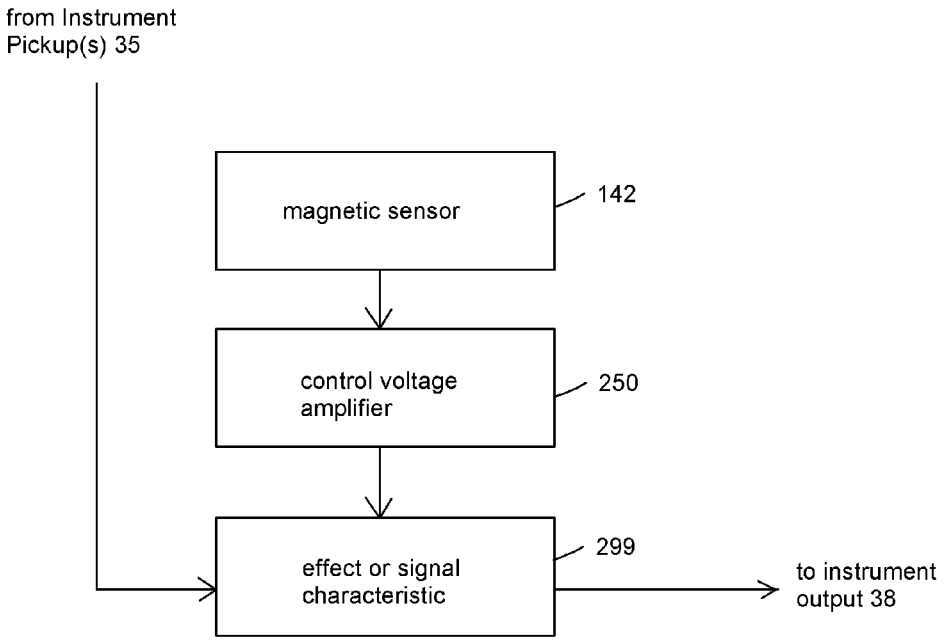
FIG. 11 is a flow chart illustrating steps in one embodiment of a method of controlling an instrument output signal based on changes in a magnetic field.

Referring now to FIG. 11, a block diagram illustrates in one embodiment of a method 400 of adjusting an instrument output signal. A signal is received from instrument pickup 35 into a circuit block 299, which may be voltage-controlled amplifier 260 (for volume control), filtering/feedback circuit 290 (for tone control), or other effect or change to the instrument's signal from pickup(s) 35. Based on a detected magnetic field B, sensor chip 142 outputs a control voltage that is amplified as needed by control signal amplifier 250. The magnitude of the control voltage from sensor chip 142 is used to determine the change to the instrument's signal, which is then output to instrument output 38.

In use, the present invention provides a player of stringed instruments, especially electric guitars, the ability to change the volume and pitch at the same time by using the vibrato bar 102. Similarly, vibrato bar 102 can be used to control tone or implement any other effect or signal change, including but not limited to wah, chorus, reverb, harmonic content, and other modification. Vibrato bar 102 is typically held by the player's palm, which leaves the fingers free to pluck the strings. The present invention allows a guitarist to simulate the volume swell of bowed instruments or slide guitar, which can produce notes with no audible attack. This feature is another tool available to the player for a unique playing style without the use of a volume pedal. The present invention similarly allows the guitarist to variably adjust tone or other effects by rotation of vibrato bar 102.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A vibrato tailpiece system for a stringed instrument comprising:

a vibrato tailpiece;

a vibrato bar having an end portion rotatable about an axis of rotation and pivotable about a second axis to affect string tension when installed in the vibrato tailpiece;

a magnet attached to the end portion of the vibrato bar and defining a magnetic field, wherein rotation of the vibrato bar about the axis of rotation rotates the magnet, thereby changing a direction of the magnetic field;

a sensor chip attached to the vibrato tailpiece and, when the vibrato bar is installed in the vibrato tailpiece, the sensor chip is spaced from the magnet by a fixed gap sufficiently small to enable the sensor chip to detect a change in the direction of the magnetic field due to a rotation of the vibrato bar about the axis of rotation and output a control signal based on the change in the direction of the magnetic field; and a sensor circuit coupled to the sensor chip and configured to receive a pickup output signal from a pickup of the stringed instrument, use the control signal from the sensor chip to adjust an amplitude of the pickup output signal, and deliver an adjusted output signal to an output connector of the stringed instrument;

wherein the vibrato tailpiece allows a user to control pitch by pivoting the vibrato bar about the second axis while at the same time rotating the vibrato bar about the axis of rotation to adjust the amplitude of the pickup output signal based on the direction of the magnetic field.

2. The vibrato tailpiece system of claim 1 further comprising a bypass switch electrically coupled between the pickup of the stringed instrument and the output connector, wherein a first position of the bypass switch delivers the pickup output signal to the output connector via the sensor circuit and a second position of the bypass switch delivers the pickup output to the output connector without the sensor circuit.

3. The vibrato tailpiece system of claim 1, wherein the magnet is a rare earth magnet.

4. The vibrato tailpiece system of claim 1, wherein the sensor chip is a magneto-resistive chip and the control signal of the sensor chip is based only on the change in the direction of the magnetic field.

5. The vibrato tailpiece system of claim 4, wherein the fixed gap is sized to result in magnetic field saturation of the sensor chip.

6. The vibrato tailpiece of system of claim 5, wherein the gap is less than 0.15 inch.

7. The vibrato tailpiece system of claim 1, wherein the control signal changes the pickup output signal only when the rotation of the vibrato bar is within a predefined sector of a circle.

8. The vibrato tailpiece system of claim 7, wherein the predefined sector is bounded to radii spaced by 45° or less.

9. The vibrato tailpiece system of claim 1, wherein the sensor chip and the magnet are coaxially aligned along the axis of rotation.

10. The vibrato tailpiece system of claim 1, wherein sensor circuit uses the control signal to attenuate the pickup output signal by an amount from 0 dB to 30 dB.

11. The vibrato tailpiece system of claim 1, wherein the sensor circuit uses the control signal to boost the pickup output signal by an amount from 0 dB to +10 dB.

12. A method of modifying an output signal of a stringed instrument equipped with a vibrato tailpiece and one or more pickups, the method comprising:

providing a stringed instrument equipped with one or more pickups, a signal output connector, a vibrato tailpiece including a vibrato bar configured for assembly with the vibrato tailpiece and having an end portion rotatable about an axis of rotation and the vibrato bar being pivotable about a second axis to affect string tension when assembled with the vibrato tailpiece, a magnet secured to the end portion of the vibrato bar, and a sensor circuit that includes a sensor chip capable of detecting a change in a direction of a magnetic field of the magnet, wherein the sensor chip is disposed a fixed distance from the magnet when the vibrato bar is assembled with the vibrato tailpiece and the sensor chip is positioned sufficiently close to the magnet to detect the change in the direction of the magnetic field, and wherein the vibrato tailpiece allows a user to control pitch by pivoting the vibrato bar about the second axis while at the same time rotating the vibrato bar about the axis of rotation to affect a pickup output signal based on the direction of the magnetic field;

assembling the vibrato bar with the vibrato tailpiece, thereby positioning the magnet the fixed distance from the sensor chip;

the sensor circuit receiving a pickup output signal from one or more pickups of the stringed instrument;

positioning the vibrato bar within a predefined sector of a circle by rotating the vibrato bar about the axis of rotation;

the sensor chip detecting the direction of the magnetic field;

the sensor chip outputting a control signal to the sensor circuit based on the direction of the magnetic field;

the sensor circuit modifying the pickup output signal based on the control signal of the sensor chip, thereby providing a modified output signal corresponding to a position of the vibrato bar within the predefined sector; and delivering the modified output signal to an output connector of the stringed instrument.

13. The method of claim 12, wherein the step of the sensor circuit modifying the pickup output signal comprises adjusting an amplitude of the pickup output signal.

14. The method of claim 13, wherein the pickup output signal is adjusted by an amount between −30 dB and +10 dB.

15. The method of claim 12, wherein the step of providing the stringed instrument includes selecting the stringed instrument further equipped with a bypass switch electrically coupled between the signal output connector and the one or more pickups, wherein the bypass switch is configured to selectively bypass the sensor circuit.

16. The method of claim 12, wherein the step of providing the stringed instrument includes selecting the stringed instrument with the sensor chip configured for anisotropic magnetoresistance, wherein the control signal is based only on a direction of the magnetic field.

17. The method of claim 12, wherein the step of assembling the vibrato bar with the vibrato tailpiece positions the magnet sufficiently close to the sensor chip to result in field saturation of the sensor chip.

18. The method of claim 12, wherein the predefined sector of the circle is bounded to radii spaced by 45° or less.

19. The vibrato tailpiece system of claim 1, wherein the vibrato tailpiece includes a vibrato block configured to extend into a body of the stringed instrument and defines a vibrato bar socket constructed to receive the end portion of the vibrato bar, wherein the sensor chip is attached to the vibrato block and aligned coaxially with the end portion of the vibrato bar.

* * * * *